US009411345B2

(12) United States Patent
Utsunomiya

(10) Patent No.: US 9,411,345 B2
(45) Date of Patent: Aug. 9, 2016

(54) VOLTAGE REGULATOR

(71) Applicant: Seiko Instruments Inc., Chiba-shi, Chiba (JP)

(72) Inventor: Fumiyasu Utsunomiya, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 14/196,750

(22) Filed: Mar. 4, 2014

(65) Prior Publication Data

US 2014/0253069 A1 Sep. 11, 2014

(30) Foreign Application Priority Data

Mar. 6, 2013 (JP) ..... 2013-044166
Jan. 10, 2014 (JP) ..... 2014-002973

(51) Int. Cl.
*G05F 1/46* (2006.01)
*G05F 1/565* (2006.01)

(52) U.S. Cl.
CPC . *G05F 1/46* (2013.01); *G05F 1/565* (2013.01)

(58) Field of Classification Search
CPC ..... G05F 1/575; G05F 1/46; G05F 1/565
USPC ..... 323/273–281
See application file for complete search history.

(56) References Cited

U.S. PATENT DOCUMENTS 6,005,378 A * 12/1999 D'Angelo ..... G05F 3/242 323/273
7,095,280 B2 * 8/2006 Regier ..... H03F 3/211 330/258
7,183,755 B2 * 2/2007 Itoh ..... H02H 9/025 323/274
7,816,897 B2 * 10/2010 Illegems ..... G05F 3/262 323/274
8,072,198 B2 * 12/2011 Imura ..... 323/276
8,169,204 B2 * 5/2012 Jian ..... G05F 1/573 323/273
2009/0195290 A1 * 8/2009 Moraveji ..... 327/331
2010/0156364 A1 * 6/2010 Cho ..... G05F 1/573 323/280
2010/0156373 A1 * 6/2010 Imura ..... G05F 1/56 323/282
2012/0013396 A1 * 1/2012 Morino ..... G05F 3/24 327/540

FOREIGN PATENT DOCUMENTS

JP 2005-092693 A 4/2005

* cited by examiner

*Primary Examiner* — Timothy J Dole
*Assistant Examiner* — Htet Z Kyaw
(74) *Attorney, Agent, or Firm* — Brinks Gilson & Lione

(57) ABSTRACT

Provided is a voltage regulator capable of controlling an output voltage to a predetermined voltage quickly after an undershoot occurs in the output voltage. The voltage regulator includes: an undershoot detection circuit configured to detect a voltage that is based on an output voltage of the voltage regulator, and output a current corresponding to an undershoot amount of the output voltage; and an I-V converter circuit configured to control a current flowing through an output transistor based on a current controlled by an output of an error amplifier and a current flowing from the undershoot detection circuit.

6 Claims, 4 Drawing Sheets

VOLTAGE REGULATOR

RELATED APPLICATIONS

This application claims priority under 35 U.S.C. §119 to Japanese Patent Application Nos. 2013-044166 filed on Mar. 6, 2013 and 2014-002973 filed on Jan. 10, 2014, the entire contents of which are hereby incorporated by reference.

BACKGROUND OF THE INVENTION

1. Field of the Invention

The present invention relates to an improvement in undershoot in a voltage regulator.

2. Description of the Related Art

FIG. 3 illustrates a circuit diagram of a related-art voltage regulator. The related-art voltage regulator includes an error amplifier 110, PMOS transistors 120, 201, and 204, NMOS transistors 202, 203, and 205, resistors 231, 232, 233, and 234, a comparator 210, an inverter 211, an offset voltage generation circuit 212, a power supply terminal 100, a ground terminal 101, a reference voltage terminal 102, and an output terminal 103.

The error amplifier 110 controls a gate of the PMOS transistor 120, and an output voltage Vout is thereby output from the output terminal 103. The output voltage Vout has a value determined by dividing a voltage of the reference voltage terminal 102 by a total resistance value of the resistor 231 and the resistor 232 and multiplying the resultant value by a resistance value of the resistor 232. When an undershoot occurs, the comparator 210 compares a voltage determined by adding a voltage Vo of the offset voltage generation circuit 212 to a divided voltage Vfb with a reference voltage Vref. When the voltage determined by adding the offset voltage Vo to the divided voltage Vfb becomes lower than the reference voltage Vref, the comparator 210 outputs "High", thereby turning on the NMOS transistor 203. When an output current IOUT is smaller than an overcurrent IL, the NMOS transistor 202 is turned on to pull down a gate of the PMOS transistor 120, thereby controlling the output voltage Vout to be increased. Consequently, the undershoot is improved, and undershoot characteristics of the voltage regulator are improved (see, for example, Japanese Patent Application Laid-open No. 2010-152451).

In the related-art voltage regulator, however, there is a problem in that it may take time to control so that a predetermined output voltage Vout may be output from the state in which an undershoot occurs and the PMOS transistor 120 is turned fully on. Further, there is another problem in that an output current may become excessive to increase the output voltage Vout while the output voltage Vout is controlled to be a predetermined output voltage from the state in which an undershoot occurs and the PMOS transistor is turned fully on.

SUMMARY OF THE INVENTION

The present invention has been made in view of the above-mentioned problems, and provides a voltage regulator that reduces time required for control of an output voltage Vout after an undershoot occurs in the output voltage Vout, thereby preventing the output voltage Vout from being increased due to an excessive output current.

In order to solve the related-art problems, a voltage regulator according to one embodiment of the present invention is configured as follows.

The voltage regulator includes: an error amplifier; an output transistor; and an undershoot detection circuit configured to detect a voltage that is based on an output voltage of the voltage regulator, and output a current corresponding to an undershoot amount of the output voltage, in which, in accordance with the current, a current flowing through the output transistor is increased.

According to the voltage regulator according to one embodiment of the present invention, the output voltage can be controlled to a predetermined voltage quickly after an undershoot occurs in the output voltage.

DETAILED DESCRIPTION OF THE PREFERRED EMBODIMENT

Now, an embodiment of the present invention is described below with reference to the accompanying drawings.

Embodiment

Figure 1:
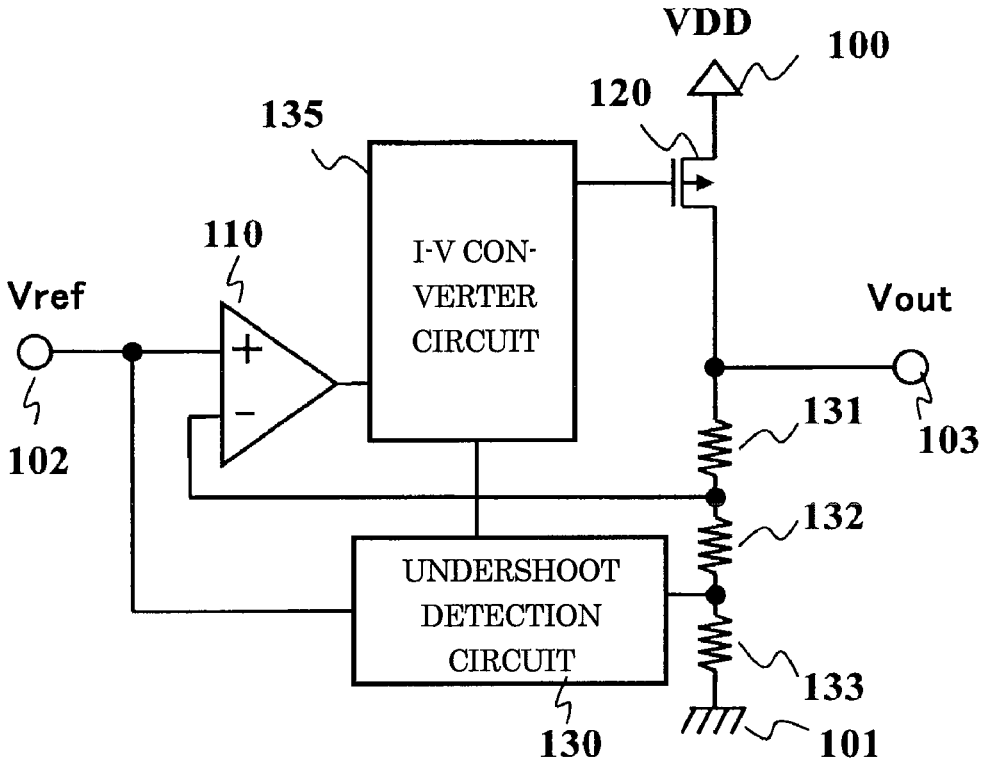
FIG. 1 is a block diagram of a voltage regulator according to an embodiment of the present invention.
Figure 2:
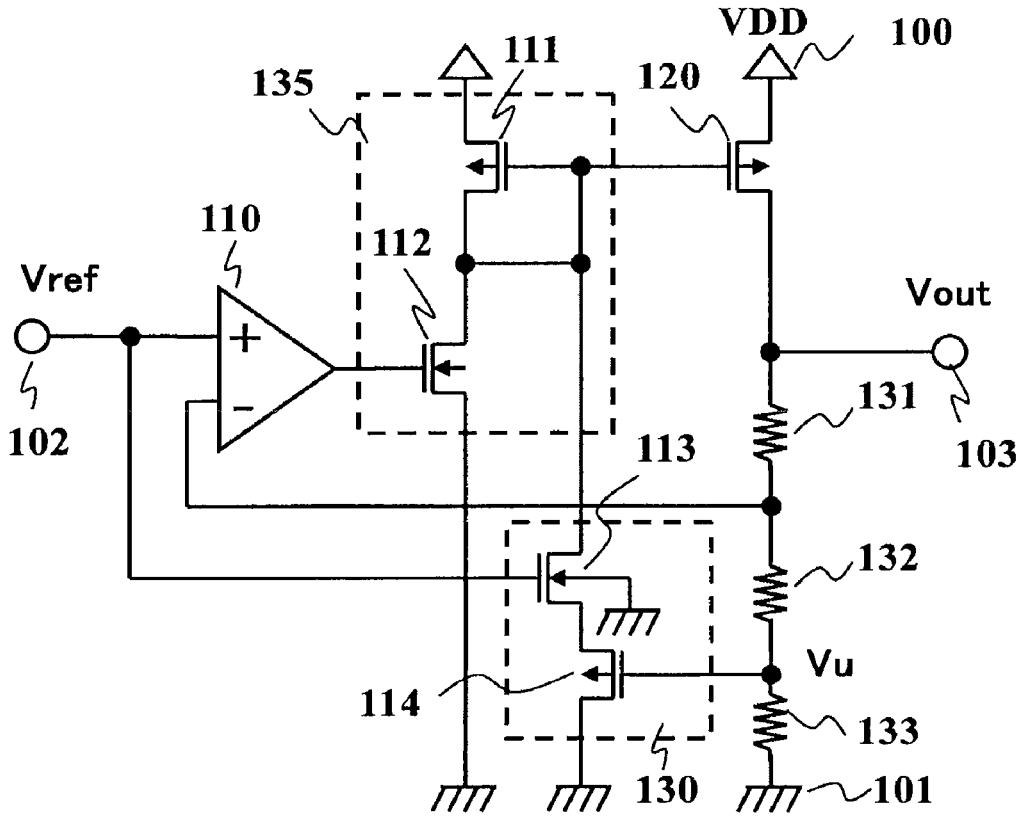
FIG. 2 is a circuit diagram of the voltage regulator according to the embodiment of the present invention.
Figure 3:
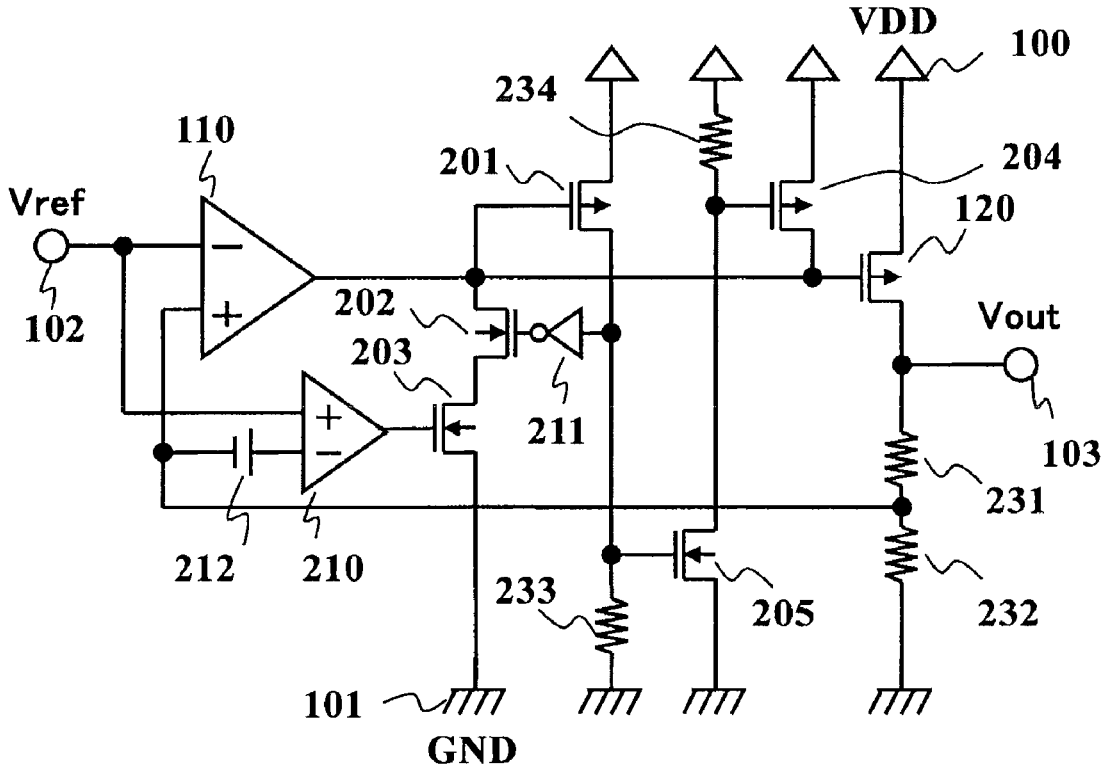
FIG. 3 PRIOR ART
FIG. 3 is a circuit diagram of a related-art voltage regulator.

FIG. 1 is a block diagram of a voltage regulator according to an embodiment of the present invention. The voltage regulator according to this embodiment includes an error amplifier 110, a PMOS transistor 120, resistors 131, 132, and 133, an undershoot detection circuit 130, an I-V converter circuit 135, a power supply terminal 100, a ground terminal 101, a reference voltage terminal 102, and an output terminal 103. The PMOS transistor 120 operates as an output transistor. FIG. 2 is a circuit diagram of the voltage regulator according to this embodiment. The undershoot detection circuit 130 includes NMOS transistors 113 and 114. The I-V converter circuit 135 includes a PMOS transistor 111 and an NMOS transistor 112.

Next, connections in the voltage regulator according to this embodiment are described. The error amplifier 110 has a non-inverting input terminal connected to the reference voltage terminal 102, an inverting input terminal connected to a connection point between one terminal of the resistor 131 and one terminal of the resistor 132, and an output terminal connected to a gate of the NMOS transistor 112. The other terminal of the resistor 131 is connected to the output terminal 103 and a drain of the PMOS transistor 120. The NMOS transistor 112 has a drain connected to a gate and a drain of the PMOS transistor 111, and a source connected to the ground terminal 101. The PMOS transistor 111 has a source connected to the power supply terminal 100. The PMOS transistor 120 has a gate connected to the gate of the PMOS transistor 111 and a source connected to the power supply terminal 100. The NMOS transistor 113 has a gate connected to the reference voltage terminal 102, a drain connected to the gate of the PMOS transistor 111, a source connected to a source of the PMOS transistor 114, and a back gate connected to the ground terminal 101. The PMOS transistor 114 has a gate connected to a connection point between the other terminal of the resistor 132 and one terminal of the resistor 133, and a drain connected to the ground terminal 101. The other terminal of the resistor 133 is connected to the ground terminal 101.

An operation of the voltage regulator according to this embodiment is now described. The reference voltage terminal 102 is connected to a reference voltage circuit to input a reference voltage Vref. The resistor 131 and the resistors 132 and 133 divide an output voltage Vout as a voltage of the output terminal 103, thereby outputting a divided voltage Vfb. The error amplifier 110 compares the reference voltage Vref to the divided voltage Vfb, and controls a gate voltage of the NMOS transistor 112 so that the output voltage Vout may be constant. When the output voltage Vout is higher than a target value, the divided voltage Vfb becomes higher than the reference voltage Vref, and an output signal of the error amplifier 110 (gate voltage of the NMOS transistor 112) decreases. Then, a current flowing through the NMOS transistor 112 is decreased. The PMOS transistor 111 and the PMOS transistor 120 construct a current mirror circuit. When the current flowing through the NMOS transistor 112 decreases, the current flowing through the PMOS transistor 120 also decreases. Because the output voltage Vout is set by the product of the current flowing through the PMOS transistor 120 and the resistances of the resistors 131, 132, and 133, when the current flowing through the PMOS transistor 120 decreases, the output voltage Vout decreases.

When the output voltage Vout is lower than a target value, the divided voltage Vfb becomes lower than the reference voltage Vref, and the output signal of the error amplifier 110 (gate voltage of the NMOS transistor 112) increases. Then, the current flowing through the NMOS transistor 112 is increased, and the current flowing through the PMOS transistor 120 is also increased. Because the output voltage Vout is set by the product of the current flowing through the PMOS transistor 120 and the resistances of the resistors 131, 132, and 133, when the current flowing through the PMOS transistor 120 increases, the output voltage Vout increases. In this manner, the output voltage Vout is controlled to be constant.

Through the operation described above, the I-V converter circuit 135 controls the current flowing through the output transistor 120 based on the current controlled by the output of the error amplifier 110.

The case is considered where an undershoot appears in the output terminal 103 and the output voltage Vout increases transiently. A voltage determined by dividing the output voltage Vout by the resistors 131 and 132 and the resistor 133 is represented by Vu. When the output voltage Vout decreases transiently, the voltage Vu also decreases to turn on the PMOS transistor 114, thereby causing a current to flow. A threshold of the NMOS transistor 113 is represented by Vtn, and a threshold of the PMOS transistor 114 is represented by Vtp. Then, the PMOS transistor 114 can be turned on when $Vref-(Vtn+|Vtp|)\geq Vu$ is satisfied. The PMOS transistor 111 causes a current to flow to the NMOS transistor 112. Further, because the output of the error amplifier 110 is not changed, if the PMOS transistor 114 is turned on, the PMOS transistor 111 needs to cause a current to flow also to the PMOS transistor 114, which increases the current flowing through the PMOS transistor 111. Because the current flowing through the PMOS transistor 111 increases, the current flowing to the PMOS transistor 120 also increases. In this manner, the output voltage Vout is controlled not to decrease any more, thereby stopping the decrease in undershoot of the output voltage Vout.

After the undershoot occurs, when the output voltage Vout is controlled to increase, the current flowing through the PMOS transistor 114 gradually decreases, and the current of the PMOS transistor 111 also gradually decreases. Then, the current of the PMOS transistor 111 returns to a normal current value, and the output voltage Vout is controlled to be constant. During this control, the PMOS transistor 120 is not turned fully on but operates to continue controlling the output voltage Vout. Consequently, the output voltage Vout can be controlled stably without being increased due to an excessive output current even immediately after the undershoot is eliminated.

Through the operation described above, the I-V converter circuit 135 controls the current flowing through the output transistor 120 based also on the current from the undershoot detection circuit 130.

Figure 4:
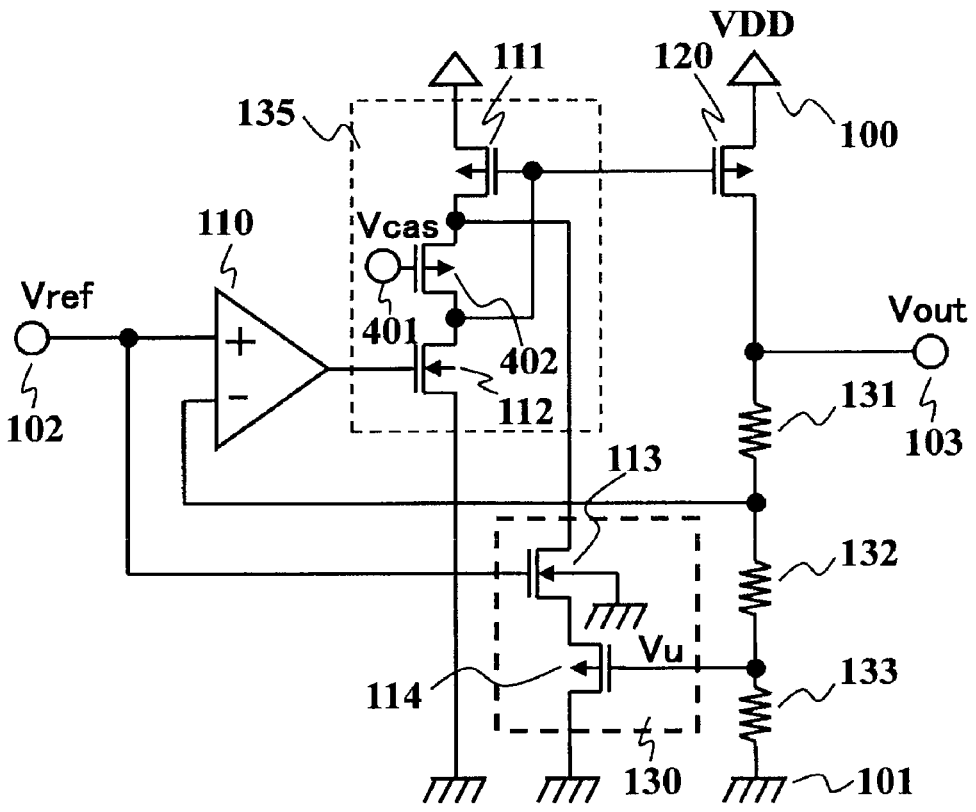
FIG. 4 is a circuit diagram illustrating another example of the voltage regulator according to the embodiment of the present invention.

FIG. 4 is a circuit diagram illustrating another example of the voltage regulator according to this embodiment. The I-V converter circuit 135 has a different configuration from that of the circuit of FIG. 2. Specifically, a PMOS transistor 402 as a cascode transistor is added to the I-V converter circuit 135.

The PMOS transistor 402 has a source connected to the drain of the PMOS transistor 111 and the drain of the NMOS transistor 113, and a drain connected to the gate of the PMOS transistor 111, the gate of the PMOS transistor 120, and the drain of the NMOS transistor 112.

A cascode voltage Vcas to be input to a gate of the PMOS transistor 402 is set to increase a drain voltage of the PMOS transistor 111 as much as possible so that the PMOS transistor 111 may operate in the saturation region. With this configuration, a drain voltage of the NMOS transistor 113 can be increased to be higher than that of the circuit of FIG. 2 by the absolute value of the threshold of the PMOS transistor 111. Consequently, the operating power supply voltage of the undershoot detection circuit 130 can be decreased by the absolute value of the threshold of the PMOS transistor 111.

As described above, the voltage regulator of FIG. 4 has an effect that the voltage regulator can be operated up to a power supply voltage lower than that of the circuit of FIG. 2.

Note that, the description has been given above by referring to FIG. 2 as the configuration of the undershoot detection circuit 130, but the present invention is not limited to this configuration. Any configuration can be used as long as an undershoot is detected and the current flowing through the output transistor 120 can be increased in accordance with a current corresponding to an undershoot amount.

As described above, the voltage regulator according to this embodiment is capable of stopping a decrease in undershoot occurring in the output voltage Vout, and stably controlling the output voltage Vout while preventing the output voltage Vout from increasing excessively after the decrease in undershoot is stopped

What is claimed is:

1. A voltage regulator, comprising:

an error amplifier;

an output transistor;

an undershoot detection circuit having a reference terminal, a feedback terminal, and a control terminal, wherein the undershoot detection circuit is configured to detect a voltage at the feedback terminal that is based on an output voltage of the voltage regulator, and output, via the control terminal, a current corresponding to an undershoot amount of the output voltage, wherein, in accordance with the current, a current flowing through the output transistor is increased; and an I-V converter circuit that comprises a first transistor controlled by the output of the error amplifier and a second transistor connected to the first transistor, wherein the second transistor forms a current mirror circuit with the output transistor, and a terminal of the second transistor is connected to the control terminal of the undershoot detection circuit, wherein the I-V converter circuit is configured to generate a current proportional to both an output voltage of the error amplifier and a current flowing from the control terminal of the undershoot detection circuit for controlling the output transistor to output a regulated voltage.

2. The voltage regulator according to claim 1, wherein:

the current flowing through the output transistor is controlled based on a current flowing through the first transistor.

3. The voltage regulator according to claim 2, wherein the first transistor includes a gate connected to the output of the error amplifier and a drain connected to a gate of the output transistor.

4. The voltage regulator according to claim 1, wherein a gate and a drain of the second transistor are connected to one another and connected to both a gate of the output transistor and a drain of the first transistor.

5. The voltage regulator according to claim 1, wherein the undershoot detection circuit comprises:

a third transistor that includes a gate that corresponds to the feedback terminal; and a fourth transistor that includes a gate that corresponds to the reference terminal and that is connected to a non-inverting input terminal of the error amplifier, a source connected to a source of the third transistor, and a drain that corresponds to the control terminal.

6. The voltage regulator according to claim 1, wherein the I-V converter circuit comprises a cascode transistor provided between the first transistor and the second transistor.

* * * * *